US012208482B2

(12) United States Patent
Aikawa

(10) Patent No.: US 12,208,482 B2
(45) Date of Patent: Jan. 28, 2025

(54) CUTTING APPARATUS

(71) Applicant: DISCO CORPORATION, Tokyo (JP)

(72) Inventor: Hiroki Aikawa, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 382 days.

(21) Appl. No.: 17/653,375

(22) Filed: Mar. 3, 2022

(65) Prior Publication Data

US 2022/0305608 A1 Sep. 29, 2022

(30) Foreign Application Priority Data

Mar. 23, 2021 (JP) ..... 2021-048443

(51) Int. Cl.
*B24B 27/06* (2006.01)
*B24B 41/06* (2012.01)

(52) U.S. Cl.
CPC ..... *B24B 27/06* (2013.01); *B24B 41/06* (2013.01)

(58) Field of Classification Search
CPC ..... B24D 3/02–06; B24D 5/16; B24B 27/06; B24B 27/0683; B24B 45/00–006
USPC ..... 451/259, 278, 442
See application file for complete search history.

(56) References Cited

U.S. PATENT DOCUMENTS 4,453,951 A * 6/1984 Ohno ..... C04B 35/532 51/307
5,316,559 A * 5/1994 Klievoneit ..... B24D 18/0018 51/293
6,306,274 B1 * 10/2001 Kajiyama ..... C25D 15/02 205/208
6,659,098 B1 * 12/2003 Sekiya ..... B23D 61/025 451/8
2002/0081776 A1 6/2002 Tellkamp
2020/0324390 A1 * 10/2020 Taguchi ..... B24D 5/16
2020/0324391 A1 * 10/2020 Taguchi ..... B28D 5/022
2021/0001445 A1 * 1/2021 Blasi ..... B23D 45/006

FOREIGN PATENT DOCUMENTS

JP 08130201 A 5/1996
JP 11300184 A 11/1999
JP 2000087282 A 3/2000
JP 2015089606 A * 5/2015
JP 2015150624 A 8/2015

OTHER PUBLICATIONS

Tokunaga, JP-2015089606-A machine translation, May 11, 2015 (Year: 2015).*
Office Action issued in counterpart Japanese patent application No. 2021-048443, dated Nov. 5, 2024.

* cited by examiner

*Primary Examiner* — Brian D Keller
*Assistant Examiner* — Marcel T Dion
(74) *Attorney, Agent, or Firm* — Greer Burns & Crain Ltd.

(57) ABSTRACT

A cutting apparatus includes a chuck table configured to hold the workpiece, and a cutting unit fitted with a cutting blade including an annular base and a cutting edge that includes abrasive grains and a binder configured to fix the abrasive grains, and is formed along an outer circumferential edge of the base. The cutting unit includes a spindle, a blade mount fitted to a distal end portion of the spindle, and a fixing nut configured to fix the cutting blade to the blade mount, and the blade mount or the fixing nut is provided with a corrosion layer formed of a material having a higher ionization tendency than a material constituting the binder.

2 Claims, 4 Drawing Sheets

CUTTING APPARATUS

BACKGROUND OF THE INVENTION

Field of the Invention

The present invention relates to a cutting apparatus that cuts a workpiece.

Description of the Related Art

A device chip manufacturing process uses a wafer having a device formed in each of a plurality of regions demarcated by a plurality of streets (planned dividing lines) arranged in a lattice manner. A plurality of device chips including respective devices are obtained by dividing the wafer along the streets. The device chips are incorporated into various electronic apparatuses such as mobile telephones, or personal computers.

A cutting apparatus is used to divide the wafer. The cutting apparatus includes a chuck table that holds a workpiece, and a cutting unit that performs cutting processing on the workpiece. The cutting unit includes a spindle. A distal end portion of the spindle is fitted with an annular cutting blade that cuts the workpiece (see Japanese Patent Laid-Open No. 2000-87282). The wafer is cut and divided by rotating the cutting blade, and making the cutting blade cut into the wafer held by the chuck table.

When the cutting apparatus cuts the workpiece, a liquid (cutting liquid) such as pure water is supplied to the workpiece and the cutting blade. The supply of the cutting liquid cools the workpiece and the cutting blade, and washes away a waste (cutting waste) produced by the cutting. However, because pure water has a high resistivity, static electricity tends to occur in a region of contact between the cutting blade rotated at a high speed and the workpiece when pure water is supplied as the cutting liquid to the workpiece and the cutting blade during the cutting processing. This may cause an electrostatic breakdown of the devices formed on the workpiece, and consequently decrease the yield of the device chips. Accordingly, a method of using pure water mixed with carbon dioxide (carbonated water) as the cutting liquid has been proposed (see Japanese Patent Laid-Open No. Hei 08-130201 and Japanese Patent Laid-Open No. Hei 11-300184). Carbonated water has a low resistivity as compared with pure water, and therefore does not readily cause static electricity even when supplied to the workpiece and the cutting blade during the cutting processing. The electrostatic breakdown of the devices is thereby suppressed.

SUMMARY OF THE INVENTION

When the workpiece is cut by using the cutting apparatus, and the supply of the cutting liquid to the cutting blade is continued, the cutting blade corrodes and wears due to the cutting liquid. In particular, when pure water mixed with carbon dioxide (carbonated water) is used as the cutting liquid, the corrosion of the cutting blade progresses easily. As a result, the strength of the cutting blade is decreased, and damage to the cutting blade and a processing defect in the workpiece tend to occur.

The present invention has been made in view of such problems. It is an object of the present invention to provide a cutting apparatus that can suppress the corrosion of a cutting blade.

In accordance with an aspect of the present invention, there is provided a cutting apparatus for cutting a workpiece.

The cutting apparatus includes a chuck table configured to hold the workpiece, and a cutting unit fitted with a cutting blade including an annular base and a cutting edge that includes abrasive grains and a binder configured to fix the abrasive grains, and is formed along an outer circumferential edge of the base. The cutting unit includes a spindle, a blade mount fitted to a distal end portion of the spindle, and a fixing nut configured to fix the cutting blade to the blade mount, and the blade mount or the fixing nut is provided with a corrosion layer formed of a material having a higher ionization tendency than a material constituting the binder.

In accordance with another aspect of the present invention, there is provided a cutting apparatus for cutting a workpiece. The cutting apparatus includes a chuck table configured to hold the workpiece, and a cutting unit fitted with a cutting blade including an annular base and a cutting edge that includes abrasive grains and a binder configured to fix the abrasive grains, and is formed along an outer circumferential edge of the base. The cutting unit includes a spindle, a blade mount fitted to a distal end portion of the spindle, and a fixing nut configured to fix the cutting blade to the blade mount, and the blade mount or the fixing nut is formed of a material having a higher ionization tendency than a material constituting the binder.

Incidentally, preferably, the binder and the corrosion layer are formed by a nickel plating layer containing sulfur, and a content rate of sulfur in the corrosion layer is higher than a content rate of sulfur in the binder. In addition, preferably, the content rate of sulfur in the corrosion layer is equal to or more than 1.2 times the content rate of sulfur in the binder.

In the cutting apparatus according to one aspect of the present invention, one or both the blade mount and the fixing nut are provided with a corrosion layer formed of a material having a higher ionization tendency than the material constituting the binder of the cutting edge of the cutting blade. Thus, when a cutting liquid is supplied to the cutting blade, the corrosion layer preferentially corrodes in a sacrificial manner, and suppresses the corrosion of the cutting edge of the cutting blade.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
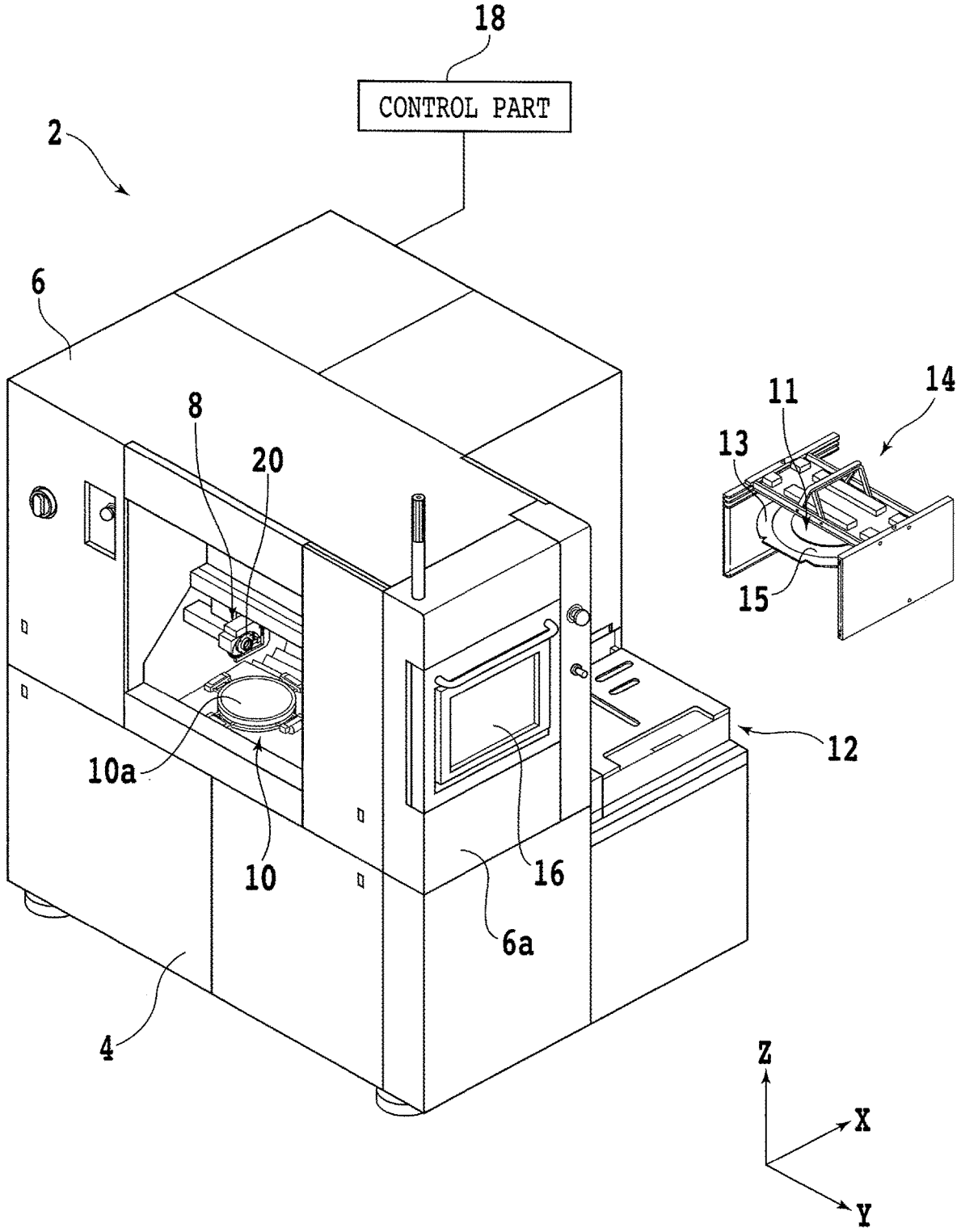
FIG. 1 is a perspective view depicting a cutting apparatus.

The present embodiment will hereinafter be described with reference to the accompanying drawings. An example of a configuration of a cutting apparatus according to the present embodiment will first be described. FIG. 1 is a perspective view depicting a cutting apparatus 2. Incidentally, in FIG. 1, an X-axis direction (a processing feed direction, a left-right direction, or a first horizontal direction) and a Y-axis direction (an indexing feed direction, a forward-rearward direction, or a second horizontal direction) are directions perpendicular to each other. In addition, a Z-axis direction (a vertical direction, an upward-downward direction, or a height direction) is a direction perpendicular to the X-axis direction and the Y-axis direction.

The cutting apparatus 2 includes a base 4 that supports and houses each constituent element constituting the cutting apparatus 2. A cover 6 that covers an upper surface side of the base 4 is provided to the upper side of the base 4. A space (processing chamber) in which a workpiece 11 is processed is formed within the cover 6. A cutting unit 8 that performs cutting processing on the workpiece 11 is provided within the processing chamber. The cutting unit 8 is fitted with an annular cutting blade (electroformed grindstone) 20, which is a tool for cutting the workpiece 11. In addition, ball screw type moving mechanisms (not depicted) that move the cutting unit 8 along the Y-axis direction and the Z-axis direction are coupled to the cutting unit 8.

A chuck table (holding table) 10 that holds the workpiece 11 is provided below the cutting unit 8. The upper surface of the chuck table 10 is a flat surface substantially parallel with a horizontal direction (XY plane direction), and constitutes a holding surface 10*a* that holds the workpiece 11. The holding surface 10*a* is connected to a suction source (not depicted) such as an ejector via a flow passage (not depicted) formed within the chuck table 10, and a valve. A ball screw type moving mechanism (not depicted) that moves the chuck table 10 along the X-axis direction is coupled to the chuck table 10. In addition, a rotational driving source (not depicted) such as a motor that rotates the chuck table 10 about a rotational axis substantially parallel with the Z-axis direction is coupled to the chuck table 10.

A cassette mounting base 12 is installed on a corner portion on the front side of the base 4. A cassette 14 that can house a plurality of workpieces 11 is mounted on the upper surface of the cassette mounting base 12. In addition, a raising and lowering mechanism (not depicted) that moves (raises and lowers) the cassette mounting base 12 along the Z-axis direction is coupled to the cassette mounting base 12. A height (position in the Z-axis direction) of the cassette 14 is adjusted by the raising and lowering mechanism such that unloading of the workpiece 11 from the cassette 14 and loading of the workpiece 11 into the cassette 14 are performed properly.

The workpiece 11 is, for example, a disk-shaped wafer formed of a semiconductor material such as silicon. The workpiece 11 has a top surface and an undersurface substantially parallel with each other. The workpiece 11 is demarcated into a plurality of rectangular regions by a plurality of streets (planned dividing lines) arranged in a lattice manner so as to intersect each other. In addition, a device such as an integrated circuit (IC), large scale integration (LSI), a light emitting diode (LED), or a microelectromechanical systems (MEMS) device is formed in each of the top surface sides of the regions demarcated by the streets. When the workpiece 11 is cut and divided along the streets by the cutting apparatus 2, a plurality of device chips each including the device are manufactured. However, a material, a shape, a structure, a size, and the like of the workpiece 11 are not limited. For example, the workpiece 11 may be a wafer (substrate) formed of a semiconductor other than silicon (GaAs, InP, GaN, SiC, or the like), sapphire, a glass (quartz glass, borosilicate glass, or the like), a resin, a ceramic, a metal, or the like. In addition, a kind, a quantity, a shape, a structure, a size, an arrangement, and the like of the devices are not limited either. No devices may be formed on the workpiece 11. Further, the workpiece 11 may be a package substrate such as a chip size package (CSP) substrate, or a quad flat non-leaded package (QFN) substrate.

When the cutting apparatus 2 processes the workpiece 11, the workpiece 11 is supported by an annular frame 13 for the convenience of handling (transporting, holding, or the like) of the workpiece 11. The frame 13 is formed of a metal such as a stainless steel (SUS). A circular opening that penetrates the frame 13 in a thickness direction is provided in a central portion of the frame 13. The diameter of the opening of the frame 13 is larger than the diameter of the workpiece 11. The workpiece 11 is disposed on the inside of the opening of the frame 13. A tape 15 is affixed to the workpiece 11 and the frame 13. The tape 15 includes a film-shaped base material formed in a circular shape and an adhesive layer (glue layer) provided on the base material. The base material is, for example, formed of a resin such as polyolefin, polyvinyl chloride, or polyethylene terephthalate. In addition, the adhesive layer is formed of an epoxy-based, an acryl-based, or a rubber-based adhesive. Incidentally, the adhesive layer may be an ultraviolet curable resin cured by irradiation with ultraviolet rays. When a central portion of the tape 15 is affixed to the undersurface (lower surface) side of the workpiece 11, and an outer circumferential portion of the tape 15 is affixed to the frame 13, the workpiece 11 is supported by the frame 13 via the tape 15. Then, the workpiece 11 is housed in the cassette 14 in a state in which the workpiece 11 is supported by the frame 13.

A transporting mechanism (not depicted) that transports the workpiece 11 is provided in the vicinity of the cassette mounting base 12. The transporting mechanism, for example, has a plurality of suction pads that suck and hold the upper surface side of the frame 13. The transporting mechanism transports the workpiece 11 in an unprocessed state from the cassette 14 to the chuck table 10, and transports the workpiece 11 in an already processed state from the chuck table 10 to the cassette 14.

A display part (display unit) 16 is provided on a front surface 6*a* side of the cover 6. The display part 16 is constituted by various kinds of displays. The display part 16 displays various kinds of information related to the cutting apparatus 2. The display part 16 can, for example, display an operating screen, a processing state, processing conditions, an image of the workpiece 11, and the like. Incidentally, the display part 16 may be a touch panel type display. In this case, the display part 16 functions as a user interface, and an operator can input information to the cutting apparatus 2 by touch operation of the display part 16. That is, the display part 16 functions also as an input part (an input unit or an input apparatus) for inputting information to the cutting apparatus 2. However, the input part may be provided separately from and independently of the display part 16. In this case, a keyboard, a mouse, or the like can be used as the input part.

Each constituent element (the cutting unit 8, the chuck table 10, the cassette mounting base 12, the display part 16, and the like) constituting the cutting apparatus 2 is connected to a control part (a control unit or a control apparatus) 18. The control part 18 generates a control signal that controls operation of each constituent element of the cutting apparatus 2. The control part 18 thereby controls operation of the cutting apparatus 2. The control part 18 is, for example, constituted by a computer. Specifically, the control part 18 includes an arithmetic unit that performs operation necessary for the operation of the cutting apparatus 2 and a storage unit that stores various kinds of information (data, a program, or the like) used for the operation of the cutting apparatus 2. The arithmetic unit includes a processor such as a central processing unit (CPU). In addition, the storage unit includes a memory such as a read only memory (ROM), and a random access memory (RAM).

The workpiece 11 housed in the cassette 14 is transported onto the chuck table 10 by the transporting mechanism and is held by the chuck table 10. The workpiece 11 is, for example, disposed on the holding surface 10*a* of the chuck table 10 via the tape 15. When a suction force (negative pressure) of the suction source is made to act on the holding surface 10*a* in this state, the workpiece 11 is sucked and held by the chuck table 10 via the tape 15.

The workpiece 11 held by the chuck table 10 is processed by the cutting unit 8. Specifically, the cutting unit 8 cuts the workpiece 11 by rotating a cutting blade 20 and making the cutting blade 20 cut into the workpiece 11. Incidentally, during cutting processing, a liquid (cutting liquid) is supplied to the workpiece 11 and the cutting blade 20. The cutting liquid cools the workpiece 11 and the cutting blade 20, and washes away a waste (processing waste) produced by the cutting processing. Then, the workpiece 11 after being processed is transported by the transporting mechanism and is housed in the cassette 14.

Figure 2A:
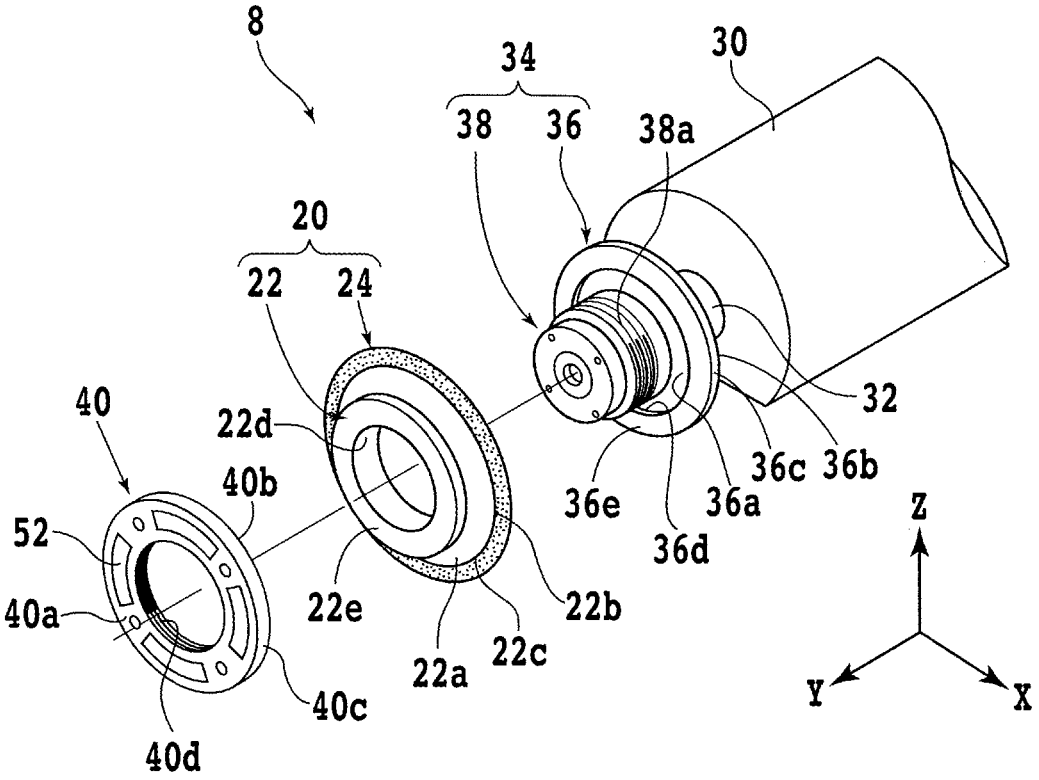
FIG. 2A is a perspective view depicting a cutting unit.

FIG. 2A is a perspective view depicting the cutting unit 8. The cutting unit 8 is fitted with the annular cutting blade 20 that cuts the workpiece 11. The cutting blade 20 includes an annular base 22, and an annular cutting edge 24 formed on the base 22.

The base 22 is formed of an electrically conductive metal (aluminum alloy or the like). The base 22 includes a front surface (first surface) 22*a* and a back surface (second surface) 22*b*, and an outer circumferential edge (side surface) 22*c* connected to the front surface 22*a* and the back surface 22*b*. A cylindrical opening portion 22*d* that penetrates the base 22 in the thickness direction is provided in a central portion of the base 22. In addition, the front surface 22*a* side of the base 22 is provided with an annular protruding portion 22*e* that protrudes from the front surface 22*a* in the thickness direction of the base 22. The annular cutting edge 24 is formed on the back surface 22*b* side of the base 22 along the outer circumferential edge 22*c*. The cutting edge 24 is formed so as to project outward in a radial direction of the base 22 from the outer circumferential edge 22*c* of the base 22. The cutting edge 24 includes abrasive grains formed of diamond, cubic Boron Nitride (cBN), or the like and a binder that is formed of a metal or the like and fixes the abrasive grains. The cutting edge 24 is, for example, formed by fixing the abrasive grains by nickel electrodeposited on an outer circumferential portion of the base 22. In this case, the binder of the cutting edge 24 is formed by a nickel plating layer. However, the material of the abrasive grains, the grain diameter of the abrasive grains, the material of the binder, and the like are not limited, but are selected as appropriate according to the material of the workpiece 11 and processing conditions.

The cutting unit 8 includes a housing 30 formed in a hollow cylindrical shape. The housing 30 houses a cylindrical spindle 32 disposed along the Y-axis direction. A distal end portion (one end side) of the spindle 32 is exposed from the housing 30. In addition, a rotational driving source (not depicted) such as a motor that rotates the spindle 32 is coupled to a proximal end portion (another end side) of the spindle 32.

The distal end portion of the spindle 32 is fitted with a blade mount 34 that supports the cutting blade 20. The blade mount 34 is formed of an electrically conductive metal (aluminum alloy or the like). The blade mount 34 includes a disk-shaped flange portion 36 and a cylindrical supporting shaft (boss portion) 38. The blade mount 34 is, for example, fixed to the distal end portion of the spindle 32 by a fixture such as a bolt.

The flange portion 36 includes a front surface (first surface) 36*a* and a back surface (second surface) 36*b* and an outer circumferential edge (side surface) 36*c* connected to the front surface 36*a* and the back surface 36*b*. In addition, an outer circumferential portion of the flange portion 36 is provided with an annular protruding portion 36*d* along the outer circumferential edge 36*c*, the annular protruding portion 36*d* protruding from the front surface 36*a* in the thickness direction of the flange portion 36. The distal end surface of the protruding portion 36*d* is a flat surface substantially parallel with the front surface 36*a*, and constitutes a supporting surface 36*e* that supports the cutting blade 20. The supporting shaft 38 is provided so as to project from a central portion of the front surface 36*a* of the flange portion 36. The central position of the flange portion 36 and the central position of the supporting shaft 38 substantially coincide with each other. In addition, a thread groove 38*a* is formed in the outer circumferential surface of the supporting shaft 38.

An annular fixing nut 40 that fixes the cutting blade 20 to the blade mount 34 is fastened to the thread groove 38*a* of the supporting shaft 38. The fixing nut 40 is formed of an electrically conductive metal (aluminum alloy or the like). The fixing nut 40 includes a front surface (first surface) 40*a* and a back surface (second surface) 40*b*, and an outer circumferential edge (side surface) 40*c* connected to the front surface 40*a* and the back surface 40*b*. A cylindrical opening portion 40*d* that penetrates the fixing nut 40 in the thickness direction is provided in a central portion of the fixing nut 40. In addition, a thread groove corresponding to the thread groove 38*a* of the supporting shaft 38 is formed in the inner circumferential surface of the fixing nut 40 which inner circumferential surface is exposed within the opening portion 40*d*.

The cutting blade 20 is fitted to the blade mount 34 such that the supporting shaft 38 is inserted into the opening portion 22*d*. When the fixing nut 40 is screwed and fastened to the thread groove 38*a* of the supporting shaft 38 in this state, the cutting blade 20 comes into contact with the supporting surface 36*e* of the flange portion 36 and the back surface 40*b* of the fixing nut 40, and is sandwiched by the blade mount 34 and the fixing nut 40. The cutting blade 20 is thereby fitted and fixed to the blade mount 34. Then, power transmitted from the rotational driving source via the spindle 32 and the blade mount 34 rotates the cutting blade 20 about a rotational axis substantially parallel with the Y-axis direction.

Figure 2B:
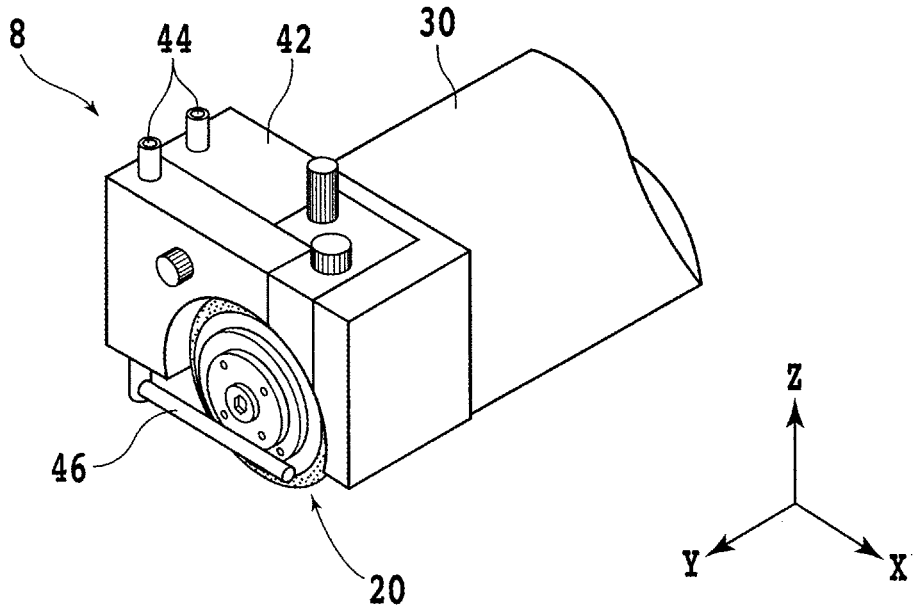
FIG. 2B is a perspective view depicting the cutting unit fitted with a blade cover.

FIG. 2B is a perspective view depicting the cutting unit 8 fitted with a blade cover 42. The cutting blade 20 fitted to the cutting unit 8 is covered by the blade cover 42 in a box shape which blade cover is fixed to the housing 30. The blade cover 42 includes a pair of connecting portions 44 supplied with the cutting liquid and a pair of nozzles 46 connected to the connecting portions 44 and disposed so as to sandwich a lower end portion of the cutting blade 20. Supply ports (not depicted) opening toward the cutting blade 20 are formed in each of the pair of nozzles 46. Piping such as tubes, or pipes as flow passages of the cutting liquid is connected to the connecting portions 44. During the cutting of the workpiece 11, the cutting liquid supplied to the connecting portion 44 flows into the nozzles 46 and is supplied from the supply ports of the nozzles 46 to the front surface and the back surface of the cutting blade 20. Pure water, for example, is used as the cutting liquid. In addition, a liquid having a lower resistivity than pure water may be used in order to suppress the generation of static electricity during the cutting processing. For example, pure water mixed with carbon dioxide (carbonated water) can also be used as the cutting liquid.

Incidentally, when the supply of the cutting liquid to the cutting blade 20 is continued during the cutting of the workpiece 11, the cutting edge 24 of the cutting blade 20 corrodes and wears due to the cutting liquid. In particular, when pure water mixed with carbon dioxide (carbonated water) is used, the corrosion of the cutting edge 24 progresses easily. When the corrosion of the cutting edge 24 occurs, the strength of the cutting edge 24 is decreased, and damage to the cutting blade 20 and a processing defect in the workpiece 11 tend to occur. Accordingly, in the present embodiment, a corrosion layer (sacrificial layer) that produces sacrificial corrosion protection is provided to one or both the blade mount 34 and the fixing nut 40. Thus, while the cutting liquid is supplied to the cutting blade 20, the corrosion layer preferentially corrodes in a sacrificial manner, and suppresses the corrosion of the binder of the cutting edge 24. As a result, a decrease in the strength of the cutting edge 24 is suppressed.

Figure 3:
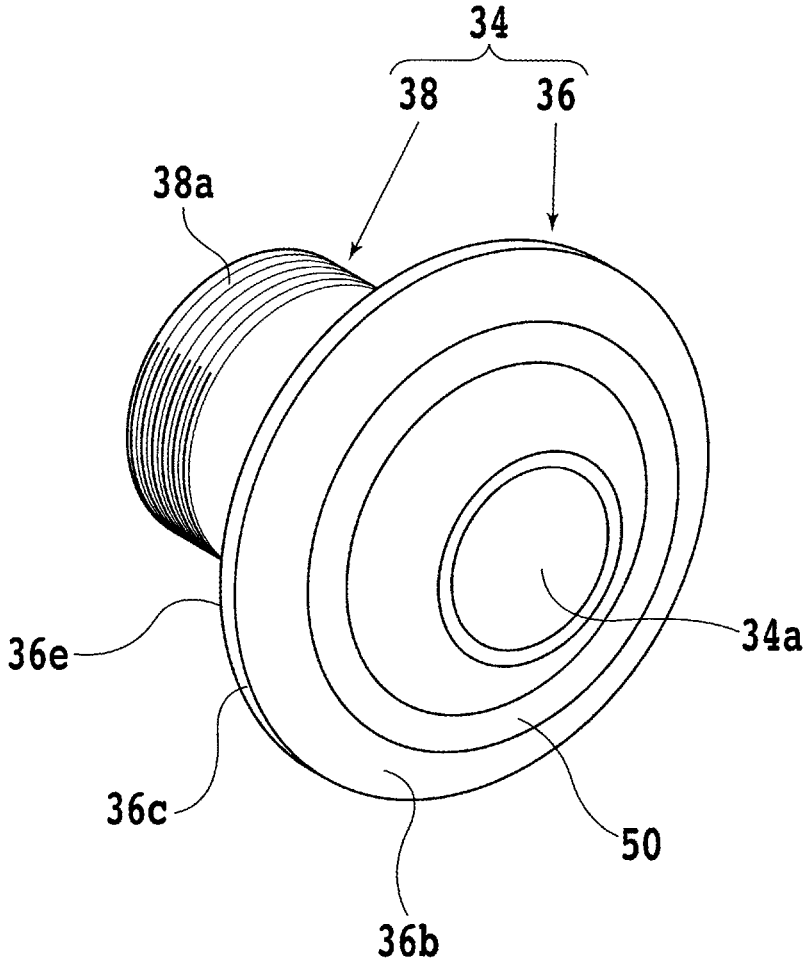
FIG. 3 is a perspective view depicting a blade mount.

FIG. 3 is a perspective view depicting the blade mount 34. A cylindrical opening portion 34*a* that opens in the back surface 36*b* of the flange portion 36 is provided to a central portion of the blade mount 34. When the blade mount 34 is fitted to the spindle 32 (see FIG. 2A), the distal end portion of the spindle 32 is inserted into the opening portion 34*a*. In addition, the blade mount 34 is provided with a corrosion layer (sacrificial layer) 50 that produces sacrificial corrosion protection. For example, the corrosion layer 50 in an annular shape having a predetermined width is formed on the back surface 36*b* side of the flange portion 36 so as to surround the opening portion 34*a*. However, the number, a size, a shape, a position, and the like of the corrosion layer 50 are not limited as long as the corrosion layer 50 is electrically connected to the blade mount 34. For example, a plurality of corrosion layers 50 may be arranged on the back surface 36*b* side of the flange portion 36 at substantially equal intervals along the circumferential direction of the flange portion 36. In addition, the corrosion layer 50 may be formed on the front surface 36*a* (see FIG. 2A) of the flange portion 36, the outer circumferential edge 36*c*, or the supporting shaft 38.

Figure 4:
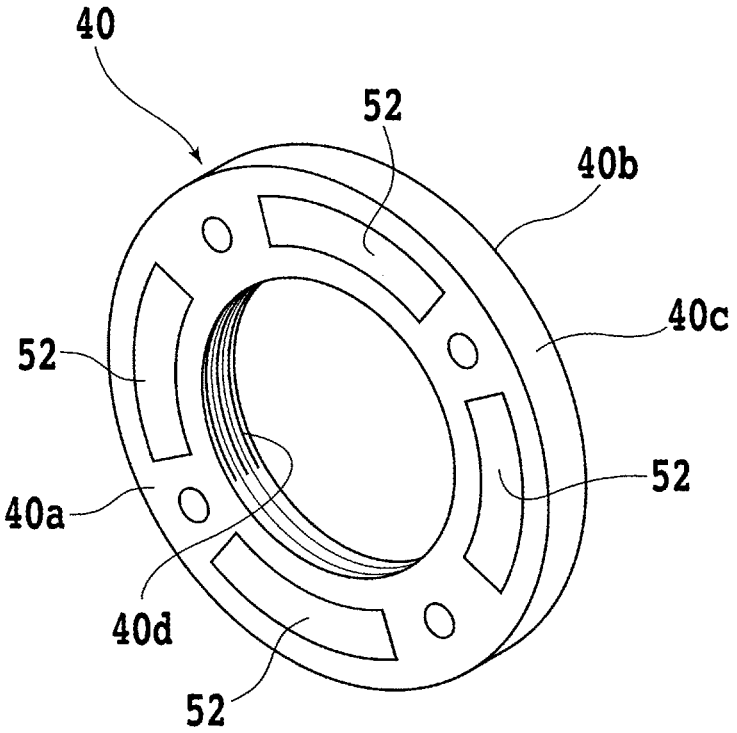
FIG. 4 is a perspective view depicting a fixing nut.

FIG. 4 is a perspective view depicting the fixing nut 40. The fixing nut 40 is provided with corrosion layers (sacrificial layers) 52 that produce sacrificial corrosion protection. For example, a plurality of arcuate corrosion layers 52 (four arcuate corrosion layers 52 in FIG. 4) having a predetermined width are arranged on the front surface 40*a* side of the fixing nut 40 at substantially equal intervals along the circumferential direction of the fixing nut 40. However, the number, a size, a shape, a position, and the like of the corrosion layers 52 are not limited as long as the corrosion layers 52 are electrically connected to the fixing nut 40. For example, an annular corrosion layer 52 may be formed continuously along the circumferential direction of the fixing nut 40. In addition, the corrosion layer(s) 52 may be formed on the back surface 40*b* or the outer circumferential edge 40*c* of the fixing nut 40.

When the cutting blade 20 is fitted to the blade mount 34 (see FIG. 2A), the cutting edge 24 comes into contact with the supporting surface 36*e* of the flange portion 36. Thus, the binder of the cutting edge 24 and the corrosion layer 50 (see FIG. 3) are electrically connected to each other via the flange portion 36. In addition, the base 22 comes into contact with the back surface 40*b* of the fixing nut 40. Thus, the binder of the cutting edge 24 and the corrosion layers 52 (see FIG. 4) are electrically connected to each other via the base 22 and the fixing nut 40.

Incidentally, the corrosion layer 50 (see FIG. 3) is preferably provided to a region other than a region that comes into contact with the cutting blade 20 (supporting surface 36*e*, see FIG. 2A) when the cutting blade 20 is fitted to the blade mount 34. Similarly, the corrosion layers 52 (see FIG. 4) are preferably provided to a region other than a region that comes into contact with the cutting blade 20 (the back surface 40*b* of the fixing nut 40, see FIG. 2A) when the cutting blade 20 is fitted to the blade mount 34. In this case, wear and peeling of the corrosion layers 50 and 52 due to contact between the corrosion layers 50 and 52 and the cutting blade 20 do not occur easily.

During the cutting processing, the cutting liquid is continuously supplied to the cutting blade 20 at a predetermined flow rate, and the cutting blade 20, the blade mount 34, and the fixing nut 40 are exposed to the cutting liquid. Here, the corrosion layers 50 and 52 are formed of a material having a higher ionization tendency than a material constituting the binder of the cutting edge 24 of the cutting blade 20. Therefore, while the cutting liquid is supplied to the cutting blade 20, the corrosion layers 50 and 52 corrode preferentially in place of the binder of the cutting edge 24. Specifically, when pure water mixed with carbon dioxide or the like is supplied as the cutting liquid to the cutting blade 20, metal ions are preferentially eluted from the corrosion layers 50 and 52 rather than from the binder of the cutting edge 24, and the corrosion of the corrosion layers 50 and 52 progresses. As a result, a sacrificial corrosion protecting effect of suppressing the corrosion of the binder of the cutting edge 24 is produced by the corrosion of the corrosion layers 50 and 52.

A concrete material of the corrosion layers 50 and 52 can be selected as appropriate according to the material of the binder of the cutting edge 24. For example, in a case where the binder of the cutting edge 24 is formed by a nickel plating layer, a metal such as aluminum, or zinc having a higher ionization tendency than nickel can be used as the corrosion layers 50 and 52. However, the binder of the cutting edge 24 and the corrosion layers 50 and 52 can also be formed by using a same material. For example, both the binder of the cutting edge 24 and the corrosion layers 50 and 52 may be formed by a nickel plating layer containing sulfur. In this case, the magnitude of ionization tendencies of the binder of the cutting edge 24 and the corrosion layers 50 and 52 is controlled by sulfur content. Specifically, the ionization tendency of the corrosion layers 50 and 52 can be made higher than the binder of the cutting edge 24 by making the content rate of sulfur in the corrosion layers 50 and 52 higher than the content rate of sulfur in the binder of the cutting edge 24. Incidentally, in order to effectively activate sacrificial corrosion protection by ensuring a sufficient difference between the ionization tendencies of the binder of the cutting edge 24 and the corrosion layers 50 and 52, the content rate of sulfur in the corrosion layers 50 and 52 is preferably set to be equal to or more than 1.2 times the content rate of sulfur in the binder of the cutting edge 24. For example, the content rate of sulfur in the corrosion layers 50 and 52 is set to be equal to or more than 0.27% by mass and equal to or less than 0.33% by mass, and the content rate of sulfur in the binder of the cutting edge 24 is set to be equal to or more than 0.17% by mass and equal to or less than 0.22% by mass.

A method of forming the corrosion layers 50 and 52 can be selected as appropriate according to the material of the corrosion layers 50 and 52. For example, in a case where a nickel plating layer containing sulfur is to be formed as the corrosion layers 50 and 52, a plating tank retaining a plating solution is first prepared. An electrolytic solution including nickel (nickel sulfate, nickel chloride, nickel sulfamate, or the like) is used as the plating solution. In addition, an additive liquid that contains sulfur at a predetermined concentration is added to the plating solution. An added amount of the additive liquid is adjusted according to a target value of sulfur content of the corrosion layers 50 and 52. Next, the blade mount 34 and the fixing nut 40 are immersed in the plating solution. At this time, masks covering regions other than regions on which to form the corrosion layers 50 and 52 are formed on the blade mount 34 and the fixing nut 40. Then, a direct current is fed to the plating solution while the plating solution is stirred. Consequently, nickel is electrodeposited on the blade mount 34 and the fixing nut 40, so that nickel plating layers (corrosion layers 50 and 52) including a predetermined content of sulfur are formed.

Incidentally, only one of the blade mount 34 and the fixing nut 40 may be provided with a corrosion layer(s). Specifically, in a case where the corrosion layer 50 is provided to the blade mount 34, the corrosion layers 52 can be omitted. Similarly, in a case where the corrosion layers 52 are provided to the fixing nut 40, the corrosion layer 50 can be omitted.

As described above, in the cutting apparatus according to the present embodiment, one or both the blade mount 34 and the fixing nut 40 are provided with a corrosion layer(s) formed of a material having a higher ionization tendency than the material constituting the binder of the cutting edge 24 of the cutting blade 20. Thus, when the cutting liquid is supplied to the cutting blade 20, the corrosion layer(s) preferentially corrode(s) in a sacrificial manner, and suppress(es) corrosion of the cutting edge 24 of the cutting blade 20.

Incidentally, the corrosion layers 50 and 52 may be provided so as to be embedded in the blade mount 34 and the fixing nut 40. For example, an annular groove is formed on the back surface 36*b* side of the flange portion 36 of the blade mount 34 so as to surround the opening portion 34*a*. Then, the corrosion layer 50 is formed so as to fill the groove. Similarly, a plurality of arcuate grooves are formed on the front surface 40*a* side of the fixing nut 40 so as to surround the opening portion 40*d*. Then, the corrosion layers 52 are formed so as to fill the grooves. Thus, the peeling of the corrosion layers 50 and 52 does not occur easily.

In addition, instead of forming the corrosion layers 50 and 52, the blade mount 34 and the fixing nut 40 themselves may be made to function as a sacrificial corrosion protecting member. Specifically, the blade mount 34 and the fixing nut 40 may be formed by a material having a higher ionization tendency than the material constituting the binder of the cutting edge 24 of the cutting blade 20. It is thereby possible to omit a process of forming the corrosion layers 50 and 52 on the blade mount 34 and the fixing nut 40. For example, the blade mount 34 is formed of a simple substance of a metal selected from iron, chromium, zinc, manganese, aluminum, and zirconium or an alloy including at least one of these metals. In addition, for example, the fixing nut 40 is formed of a simple substance of a metal selected from iron, chromium, zinc, manganese, titanium, and zirconium or an alloy including at least one of these metals.

Incidentally, only one of the blade mount 34 and the fixing nut 40 may be formed by a material having a higher ionization tendency than the material constituting the binder of the cutting edge 24. In addition, the whole of each of the blade mount 34 and the fixing nut 40 may be formed by a material having a higher ionization tendency than the material constituting the binder of the cutting edge 24, or only a partial region of each of the blade mount 34 and the fixing nut 40 may be formed by a material having a higher ionization tendency than the material constituting the binder of the cutting edge 24.

Besides, structures, methods, and the like according to the foregoing embodiment can be modified and implemented as appropriate without departing from the objective scope of the present invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cutting apparatus for cutting a workpiece, the cutting apparatus comprising:

a chuck table configured to hold the workpiece; and a cutting unit fitted with a cutting blade including an annular base and a cutting edge that includes abrasive grains and a binder configured to fix the abrasive grains, and is formed along an outer circumferential edge of the base, the cutting unit including a spindle, a blade mount fitted to a distal end portion of the spindle, and a fixing nut configured to fix the cutting blade to the blade mount, and the blade mount or the fixing nut being provided with a corrosion layer formed of a material having a higher ionization tendency than a material constituting the binder, wherein the binder and the corrosion layer are formed by a nickel plating layer containing sulfur, and a content rate of sulfur in the corrosion layer is higher than a content rate of sulfur in the binder.

2. The cutting apparatus according to claim 1, wherein the content rate of sulfur in the corrosion layer is equal to or more than 1.2 times the content rate of sulfur in the binder.

* * * * *